US005146967A

United States Patent [19]

Chapman

[11] Patent Number: 5,146,967

[45] Date of Patent: Sep. 15, 1992

[54] GOLF BAG RAIN COVER

[76] Inventor: James W. Chapman, 4645 Savage Hills Dr., Macon, Ga. 31210

[21] Appl. No.: 812,030

[22] Filed: Dec. 23, 1991

[51] Int. Cl.[5] ..... A63B 55/00; A63B 57/00

[52] U.S. Cl. ..... 150/159; 206/315.4; 280/DIG. 5

[58] Field of Search ..... 150/154, 159, 160; 206/315.4; 280/DIG. 5, DIG. 6

[56] References Cited

U.S. PATENT DOCUMENTS

| | | | |
|---|---|---|---|
| 2,702,062 | 2/1955 | Jenswold | 150/154 |
| 2,704,563 | 3/1955 | Henrich | 150/159 |
| 2,718,251 | 9/1955 | Barbato | 150/159 |
| 2,985,212 | 5/1961 | Dozier . | |
| 3,521,689 | 7/1970 | Woods, Jr. . | |
| 3,707,279 | 12/1972 | Kaiser . | |
| 3,754,587 | 8/1973 | Rainieri . | |
| 4,234,025 | 11/1980 | Berge . | |
| 4,474,388 | 10/1984 | Wagner | 206/315.4 |
| 4,498,579 | 2/1985 | Brick . | |
| 4,930,591 | 6/1990 | Lanius et al. | 280/DIG. 5 |
| 5,005,623 | 4/1991 | Webster, Jr. | 150/159 |
| 5,024,259 | 6/1991 | Treadway | 150/159 |

*Primary Examiner*—Gary E. Elkins
*Attorney, Agent, or Firm*—James A. Hinkle

[57] ABSTRACT

A golf bag rain cover is provided in the form of an envelope that is open at a bottom edge and has a closed top-edge roof. An access surface is provided with at least one access slot parallel to the roof and positioned a select distance below the roof. An access flap is attached above the slot and allowed to hang down over the access slot to a position below the slot. A quick-disconnect fastener is provided for attaching the access flap to the golf bag rain cover below the access slot. Attachment means, which can be quick-disconnect fasteners, are provided at sides and at an attachment surface of the golf bag rain cover for attachment to framework of a golf car. Typically there are two access slots with access flaps for two golf bags side-by-side on back of a golf car.

20 Claims, 3 Drawing Sheets

GOLF BAG RAIN COVER

BACKGROUND OF THE INVENTION

1. Field of the Invention

This invention relates to golf bag covers. In particular, it relates to a cover positioned over golf bags on a golf car in a manner that golf clubs and balls can be accessed while covered on the golf car.

2. Description of Prior Art

Prior golf bags covers have been devised for covering golf bags to be carried or positioned on a hand-mobile golf cart. None have been constructed to cover golf bags on an automotive golf car. This is a significant problem for golfers because golf cars are used commonly for golfing nowadays. Golf cars have made golf possible and pleasurable for many more people than golf carts. However, support equipment has not kept up with the golf car.

Golf cars have a roof but do not have sides. Sometimes there is a fringe on the top that gives the impression of protection from rain. But the roof is not adequate protection because rain falls or is blown at angles. To put sides on the golf car would defeat its purpose of being open and accessible. It is highly desirable, therefore, to have a golf bag cover adapted particularly for golf cars.

Examples of prior art include the following U.S. patent documents:

| U.S. Pat. No. | DATE | NAME | CLASSIFICATION |
|---|---|---|---|
| 4,498,579 | 2/12/1985 | Brick | 206/315.4 |
| 4,234,025 | 11/18/1980 | Berge | 150/1.5 R |
| 3,754,587 | 8/28/1973 | Rainieri | 150/52 G |
| 3,707,279 | 12/26/1972 | Kaiser | 263/2 R |
| 3,521,689 | 7/28/1970 | Woods | 150/1.5 |
| 2,985,212 | 5/23/1961 | Dozier | 150/52 |

The Brick patent teaches a cover similar to a reversible hat that fits over the top of golf clubs in a golf bag. It has a towel on one side and is water-repellant on the other side. This does not allow golf clubs and balls to be accessed without exposing them to rain when the cover is off. This is an admitted problem because a towel is provided on one side to wipe clubs when they get wet. But it has no way to keep rain out of a golf bag when the cover is off for access to golf clubs in a golf bag. The Berge patent is a cover that allows access to clubs by lifting of a flap. But is not attachable to a golf car. It provides for only one golf bag and there is no way to tie down the flap. The Rainieri device likewise is limited to only one golf bag with side openings for shoulder straps on a single golf bag. Kaiser taught a heater for golf balls and for handles of golf clubs and golf carts. Woods described a zipper bag positioned over the top of a golf bag. Dozier taught an additional type of cover for a single golf bag.

None of the devices found to exist in the prior art, and none known to exist, have an envelope shape with an access orifice coverable by a flap on one surface and a means for attachment to a golf car such as this invention.

SUMMARY OF THE INVENTION

One object of this invention is to provide a golf bag rain cover that is attachable conveniently to a golf car.

Another object is to provide ease of accessibility to golf clubs and golf balls in a golf bag covered by a golf bag rain cover on a golf car.

Another object is to provide a golf bag rain cover that can be folded or rolled into a small volume in order to be transported easily in a golf bag or on one's person when not in use.

Another object is to provide a golf bag rain cover that is rain-proof.

Another object is to provide a golf bag rain cover that is sufficiently transparent or translucent for visibility of golf clubs through it.

Another object is to provide a golf bag rain cover with an access orifice that is covered with a cover that is conveniently fastened and unfastened.

Another object of this invention is to provide a golf bag rain cover that can contain more than one golf bag.

Another object is to provide a cover which allows access to golf clubs while at the same time keeping rain out of the golf bag and off of clubs in the golf bag.

Yet another object is to provide an inexpensive and longlasting golf bag cover.

This invention accomplishes the above and other objectives with a golf bag rain cover in the form of an envelope that is open at a bottom edge and has a closed topedge roof. An access surface is provided with at least one access slot parallel to the roof and positioned a select distance below the roof. An access flap is attached above the slot and allowed to hang down over the access slot to a position below the slot. A quick-disconnect fastener is provided for attaching the access flat to the golf bag rain cover below the access slot. Attachment means, which can be quick-disconnect fasteners, are provided at sides and at an attachment surface of the golf bag rain cover for attachment to framework of a golf car. Typically there are two access slots with access flaps for two golf bags side-by-side on back of a golf car.

Other objects, advantages and capabilities of the invention will become apparent from the following description taken in conjunction with the accompanying drawings showing preferred embodiments of the invention.

DESCRIPTION OF THE PREFERRED EMBODIMENT

Figure 6:
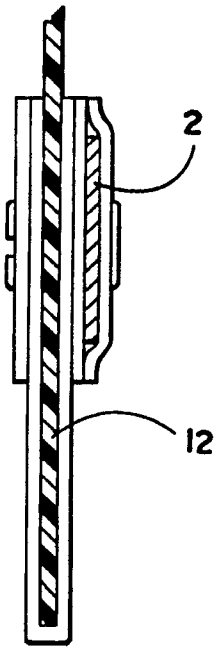
FIG. 6 is a cross-sectional view of an attachment strap at a side of the golf bag rain cover.

Referring to the drawings wherein the like reference numerals designate corresponding parts throughout the several figures, a golf bag rain cover 1 in the general form of an envelope is shown with a side-attachment strap 2 with which the envelope 1 is attached to a golf car 3. Access orifices 4 in the form of access slots are coverable with access flaps 5 and are parallel to roof edge 6. An access surface 7 in which the access orifices 4 are positioned can rest on the golf car 3 or hang over golf bags positionable in the golf bag cover. The material from which the envelope is constructed can be transparent plastic or any other flexible material. The flaps 5 can be made of the same or different material as the envelope 1.

Figure 2:
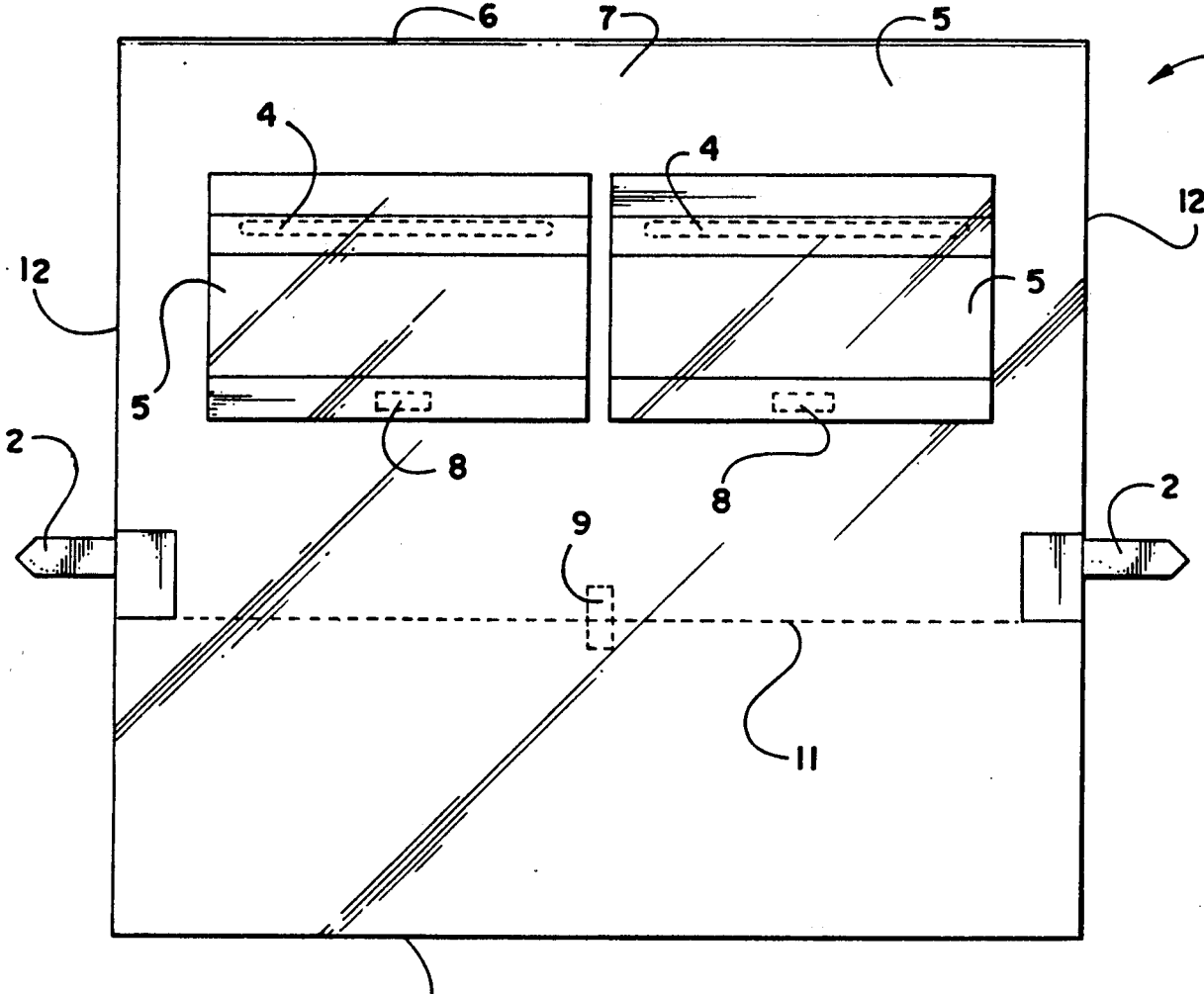
FIG. 2 is an access-side elevation view with attachment straps at sides.

Referring to FIG. 2, the side-attachment straps 2 are shown extended from opposite sides of the cover envelope 1. Cover fasteners 8 are shown in broken lines to represent positioning between access flaps 5 and access surface 7 when in a closed position over access orifices 4. Also shown in broken lines, due to its position at an opposite side of the cover 1, is an attachment-surface fastener 9.

Figure 3:
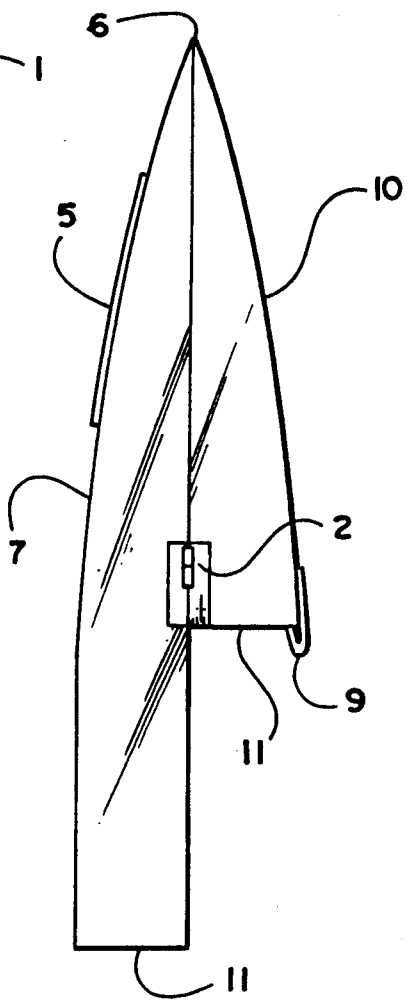
FIG. 3 is an end view having an access flap in covered position, one side strap and a rear strap.

Referring to FIG. 3, an access surface 7 is shown extended optionally and preferably lower than an attachment surface 10 to which attachment-surface fastener 9 is attached. The roof edge 6 is shown above an access flap 5 in a closed position of the flap 5. An open bottom 11 of the envelope 1 extends from the attachment surface 10 horizontally to a side edge 12 where the side-attachment strap 2 is positioned.

Figures 4, 5:
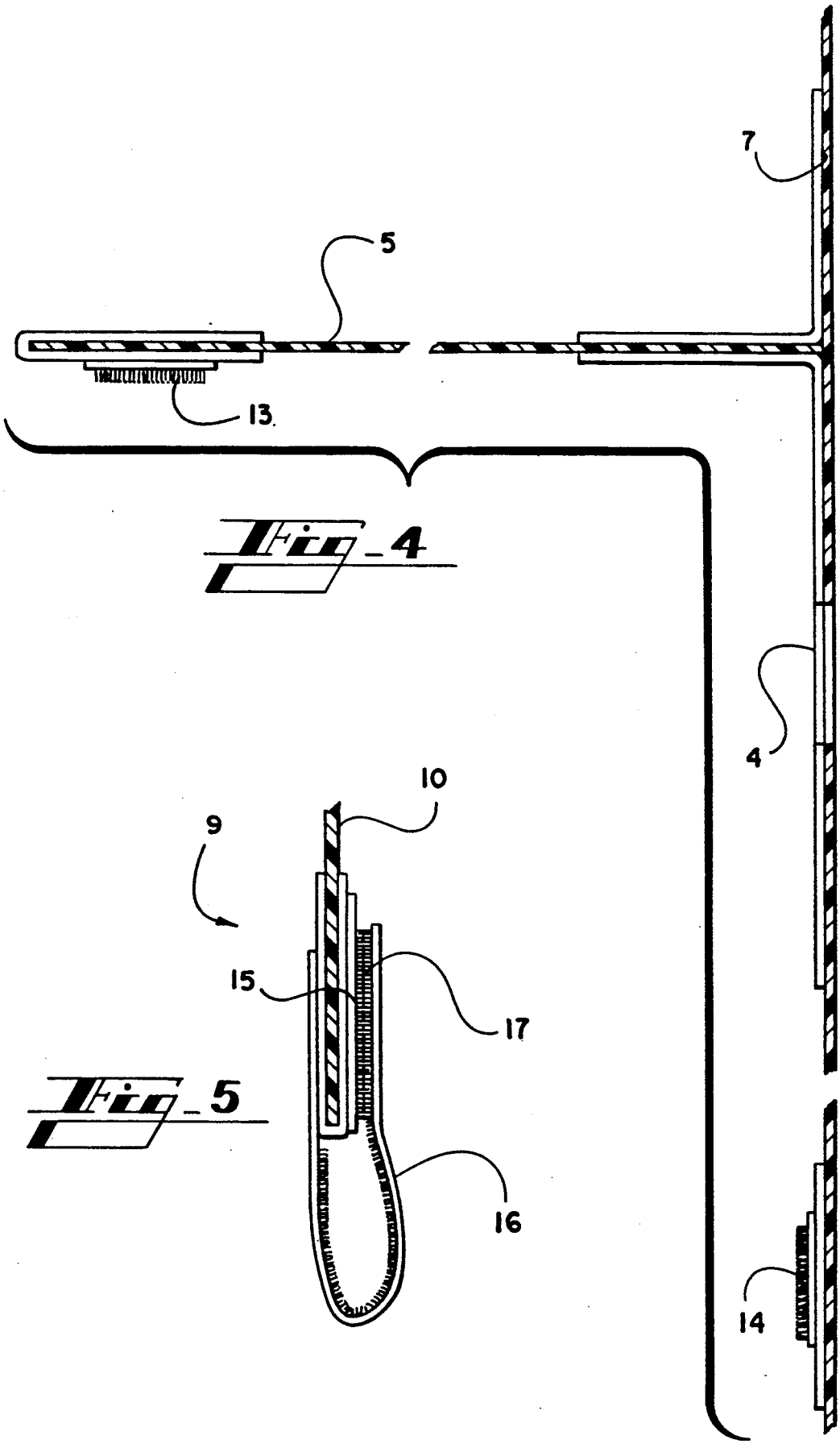
FIG. 4 is a cross-sectional view of an access flap attached to an access surface of the cover and extended at a right angle in an open position.
FIG. 5 is a cross-sectional view of a golf-carattachment strap on an attachment surface of the golf bag rain cover.

Referring to FIG. 4, an access flap 5 is extended from access surface 7 in open position relative to access orifice 4. Flap hooked-fiber member 13 is positioned on surface hooked-fiber member 14 to form a fastener in combination. It is a form of quick-disconnect fastener known by its trade name Velcro in the art to which it applies.

Referring to FIG. 5, an attachment surface 10 is provided with attachment-surface hooked-fiber member 15. An attachment-surface strap 16 is provided with strap hooked-fiber member 17 to form in combination attachment-surface fastener 9.

Figure 1:
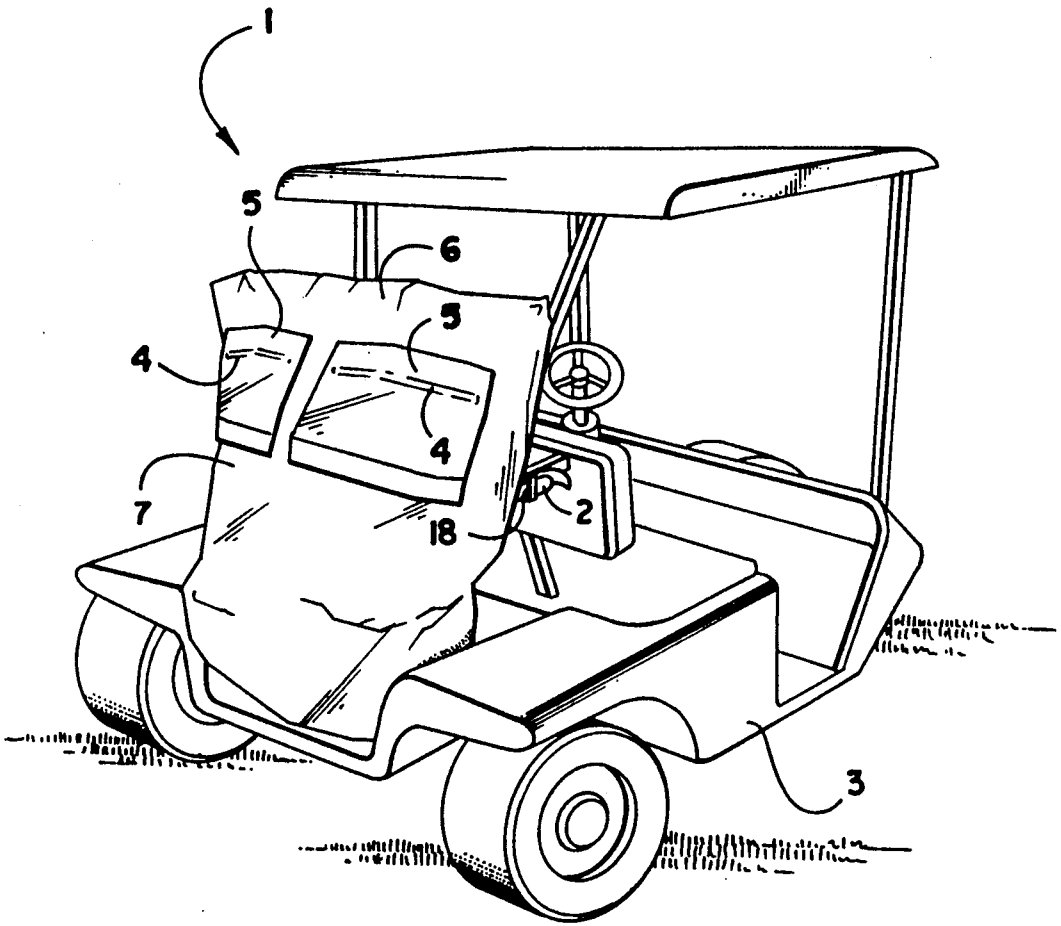
FIG. 1 is a perspective view of this golf bag rain cover attached to a golf car.

Referring to FIG. 6, a side-attachment strap 2 attached to a side edge 12 can be attachable with a buckle 18 as illustrated in FIG. 1 or it also can be a hooked-fiber or other form of fastener or quick-disconnect fastener. The buckle 18 or other fastener means can be attached to the golf car 3.

When made of a flexible material, this envelope cover 1 can be folded to approximately the size and shape of a folded telescope umbrella about an inch and a half in diameter and eight inches long.

Various modifications may be made of the invention without departing from the scope thereof and it is desired, therefore, that only such limitations shall be placed thereon as are imposed by the prior art and which are set forth in the appended claims.

What is claimed is:

1. A golf bag rain cover constructed of flexible material as an envelope which is sized and shaped to receive at least one golf bag in standing condition with golf clubs positioned therein, an open bottom of the envelope through which at least one golf bag is insertable, a roof edge opposite the open bottom of the envelope, at least one access orifice positioned a select distance down from the roof edge on an access surface of the envelope and proximate ends of the golf clubs positioned in the golf bag, an access flap having a surface larger than an open area of the access orifice and attached to the access surface at a position above the at-least-one access orifice and swivelable flexibly between an access-orifice-covered position and an access-orifice-uncovered position, and a means for attachment of the envelope to a golf car.

2. A golf bag rain cover according to claim 1 and further comprising a fastener means in fastenable relationship between the access flap and the access surface at a position below the access orifice.

3. A golf bag rain cover according to claim 2 wherein the fastener means is a quick-disconnect fastener means.

4. A golf bag rain cover according to claim 3 wherein the quick-disconnect means is a hooked-fiber surface on the access flap that is positioned on a matching hooked-fiber surface on the access surface of the envelope.

5. A golf bag rain cover according to claim 1 wherein the flexible material is transparent.

6. A golf bag rain cover according to claim 1 wherein the access orifice is a slot parallel to the roof edge of the envelope.

7. A golf bag rain cover according to claim 1 wherein the means for attachment of the envelope to a golf car is a strap extended from each side of the envelope.

8. A golf bag rain cover according to claim 7 and further comprising a fastener means on the strap extended from each side of the envelope.

9. A golf bag rain cover according to claim 8 wherein the fastener means on the strap is a hooked-fiber surface on a surface of the strap that is positioned in fastener relationship to a matching hooked-fiber surface on a separate portion of the surface of the strap.

10. A golf bag rain cover according to claim 1 wherein the means for attachment of the envelope to a golf car is a fastener means on an attachment surface of the envelope opposite the access surface of the envelope.

11. A golf bag rain cover according to claim 10 wherein the fastener means on the attachment surface of the envelope is a strap having a hooked-fiber surface and a matching hooked-fiber surface on the attachment surface of the envelope.

12. A golf bag rain cover according to claim 1 wherein the envelope is sized and shaped to receive a plurality of golf bags in upright standing position side-by-side with golf clubs insertable in the golf bags and further comprising:

a plurality of access orifices matching the plurality of golf bags for which the envelope is sized and shaped to receive side-by-side and positioned in proximity to ends of the golf clubs insertable in the golf bags, and an access flap attached to the envelope above each access orifice and swivelable flexibly between an access-orifice-covered position and an access-orifice-uncovered position in relationship to each access orifice.

13. A golf bag rain cover according to claim 12 and further comprising a fastener means in fastenable relationship between each access flap and a surface of the envelope below each access orifice.

14. A golf bag rain cover according to claim 13 wherein the fastener means is a hooked-fiber surface on each access flap and a matching hooked-fiber surface on the access surface of the envelope.

15. A golf bag rain cover according to claim 14 wherein the plurality of access orifices are slots positioned side-by-side and parallel to the roof edge of the envelope in proximity to ends of golf clubs in the plurality of golf bags.

16. A golf bag rain cover constructed of flexible material as an envelope sized and shaped to receive a plurality of golf bags side-by-side in standing condition with golf clubs positioned therein;

an open bottom of the envelope through which the plurality of golf bags are insertable, a roof edge opposite the open bottom of the envelope, a plurality of slot-shaped access orifices positioned side-by-side and parallel to the roof edge of the envelope in proximity to ends of golf clubs in the plurality of golf bags a select distance down from the roof edge on an access surface of the envelope, an access flap having a surface larger than an open area of the access orifice and attached to the access surface at a position above each of the plurality of slot-shaped orifices and swivelable flexibly between an access-orifice-covered position and an access-orifice-uncovered position, and a means for attachment of the envelope to a golf car.

17. A golf bag rain cover according to claim 16 and further comprising a hooked-fiber attachment means on each access flap and a matching hooked-fiber attachment means on matching fastener positions on the access side of the envelope below each slot-shaped access orifice.

18. A golf bag rain cover according to claim 17 wherein the means for attachment to the golf car is a strap extended from each side of the envelope to fastener positions on the golf car.

19. A golf bag rain cover according to claim 16 wherein the means for attachment to the golf car is at least one strap extended from an attachment surface of the envelope opposite the access surface of the envelope.

20. A golf bag rain cover according to claim 19 and further comprising a strap extended from each side of the envelope to fastener positions on the golf car.

* * * * *